United States Patent [19]

Hewitt

[11] Patent Number: 4,986,857

[45] Date of Patent: Jan. 22, 1991

[54] HOT WORKING AND HEAT TREATMENT OF CORROSION RESISTANT STEELS

[75] Inventor: Jack Hewitt, Middelburg, South Africa

[73] Assignee: Middelburg Steel and Alloys (Proprietary) Limited, Transvaal Province, South Africa

[21] Appl. No.: 351,435

[22] Filed: May 12, 1989

[30] Foreign Application Priority Data

May 19, 1988 [ZA] South Africa ..... 88/3551

[51] Int. Cl.[5] ..... C21D 8/00

[52] U.S. Cl. ..... 148/12 EA; 148/12 E; 148/12 R; 148/12 B

[58] Field of Search ..... 148/12 R, 12 E, 12 EA, 148/12 B

[56] References Cited

FOREIGN PATENT DOCUMENTS

| | | | |
|---|---|---|---|
| 0181740 | 5/1986 | European Pat. Off. . | |
| 3434744A1 | 4/1986 | Fed. Rep. of Germany . | |
| 2056530 | 3/1987 | Japan | 148/12 E |
| 2158745A | 11/1985 | United Kingdom . | |
| 2179432A | 3/1987 | United Kingdom . | |

OTHER PUBLICATIONS

The Making, Shaping and Treating of Steel, 10th Edition, pp. 1253–1254, Association of Iron & Steel Engineers.

*Primary Examiner*—Deborah Yee

*Attorney, Agent, or Firm*—Webb, Burden, Ziesenheim & Webb

[57] ABSTRACT

A method of heat treating a body of corrosion resistant steel which is, preferably, in coil form, having an austenitic to ferrite and carbide transformation temperature lying between 650° C. and 850° C. and a composition which results in a steel preferably having mechanical properties typically as follows:

Proof stress 350MPa, ultimate tensile stress 520MPa, elongation 25% and Brinell hardness 165 and from which Martensite microstructures are generally absent at cooling rates lower than 5° C./min and where the method comprises: hot working the steel body at above the transformation temperature; cooling the hot worked steel body to below the transformation temperature at a cooling rate of between 10° C./min and 1° C./min determined to ensure generally the absence of Martensite microstructures throughout the body.

24 Claims, 8 Drawing Sheets

HOT WORKING AND HEAT TREATMENT OF CORROSION RESISTANT STEELS

THIS INVENTION relates to the heat treatment of corrosion resistant steels and, more particularly, non-austenitic steels.

In general, corrosion resistant steels all contain chromium to a greater or lesser extent and are produced in large measure to rolled steel plate or sheet of various thicknesses. The steels are generally continuously cast from ladles filled with steel from melting furnaces into billets or blooms which are then subjected to a hot rolling operation. From the hot mill the plate or sheet material is coiled and then cooled under ambient conditions. Thereafter, the material is subjected to a thermal treatment comprising a reheating and annealing or tempering process. The steel at the end of this annealing and tempering stage has the required mechanical properties for which it is designed.

It may be sold at this stage or further reduced in thickness by cold rolling.

It is normal practice, and considered essential, to anneal or temper all hot rolled coil prior to sale or cold rolling.

The thermal treatment process may be :

a. a continuous annealing or tempering process whereby the coil is unwound and fed through a furnace held at an appropriate temperature for a particular grade, a typical example being around 750° C. for the type of steel sold under the name 3CR12.

b. alternatively, a batch annealing process is used where the coil, or coils, are placed in a suitable furnace and subjected to a heating, holding and cooling cycle to achieve the necessary annealing or tempering. The overall time for the batch anneal cycle is dependent upon the mass of coil, or coils, in the unit and, on the operating characteristics of the unit but, typically, requires 30 to 40 hours total time for a 30 ton batch.

c. alternatively, the steel may be cut into appropriate lengths and these are individually annealed in a unit such as a roller-hearth annealing furnace.

Typical examples of corrosion resistant steels for which the above processes are used are those sold under trade names and having uses respectively as follows:

PROCESS A

3CR12 as stated above—for use in mildly corrosive environments where good weldability characteristics are required.

PROCESS B

4003 —a container steel

PROCESS C

409 —limited use. e.g. motor vehicle exhausts

410 —Cutlery

As stated, all these steels and applied processes require the use of some form of annealing furnace which involves heavy capital costs both in production and equipment.

It is an object of the present invention to provide a method of heat treatment and apparatus for use in the production of corrosion resistant steels which obviates the use of an annealing furnace.

According to this invention there is provided a method of heat treating a body of corrosion resistant steel having (1) an austenitic to ferrite and carbide transformation temperature ($A_3$) between 650° C. and 850° C. and (2) a composition resulting in a steel having the following mechanical properties typically—

| | |
|---|---|
| Proof stress | 350 MPa |
| Ultimate tensile strength | 520 MPa |
| Elongation | 25% |
| Brinell hardness | 165 |

and the substantial absence of Martensite microstructures at cooling rates lower than 5° C./min, the method comprising:

hot working the steel body at above the $A_3$ transformation temperature; and cooling the hot worked steel body to below the transformation temperature at a cooling rate of between 10° C./min and 1° C./min determined to ensure substantially absence of Martensite microstructures throughout the body.

Further features, according to the invention, include insulating the body against excessive heat loss and partly enclosing the body in a thermally insulating housing which may include heat reflectors on its interior surfaces.

Still further features, according to the invention, the insulating housing may have a lining of non-conductive insulation and may be open bottomed and adapted to be lowered over the body.

Still further features, according to the invention, the steel body may be of material composition designed for production of corrosion resistant steel having a non austenitic microstructure and, preferably, the material composition of the steel body falls within the range of steels having the following components by mass:

| | |
|---|---|
| Chromium | 10–18% |
| Manganese | 2,5% max |
| Silicon | 2,0% max |
| Nickel | 0,0–5% |
| Carbon | 0,25% max |
| Nitrogen | 0,1% max |
| Titanium | 0–1,0% |
| Molybdenum | 0–1,0% |
| Vanadium | 0–1,0% |
| Zirconium | 0–1,0% |
| Niobium | 0–1,0% |
| Copper | 0–2,0% |
| Aluminium | 0,5% max |
| Phosphorus | 0,1% max |

The balance being iron and unavoidable impurities.

Still further features, according to the invention, the Ferrite Factor of the material composition of the steel body is determined by use of the following formula—Ferrite Factor $=\%Cr+6\times\%Si+8\times\%Ti+4\times\%Nb+4\times\%Mo+2\times\%Al-2\times\%Mn-4\times\%Ni\times40-(\%C+\%N)-20\times\%P-5\times\%Cu$ (% =mass per cent), and the determined Ferrite Factor of the steel body is used to construct a continuous cooling Transformation diagram which is used to determine the cooling rate of the steel body required to minimize formation of Martensite microstructures and, preferably, the Ferrite Factor lies between 8 and 12.

Still further, according to the invention, the steel body may be in coil form.

The invention embraces the apparatus for carrying out the method of heat treatment as herein described, which comprises a housing substantially enclosing the steel body and having thermal insulating properties. Said housing may have reflective interior surfaces or a lining of non-conductive insulation or both. Also the' housing may have an open bottom and be adapted to be lowered over the steel body.

The invention will be described below more fully, with reference to the accompanying diagrams in which.

Figure 1:
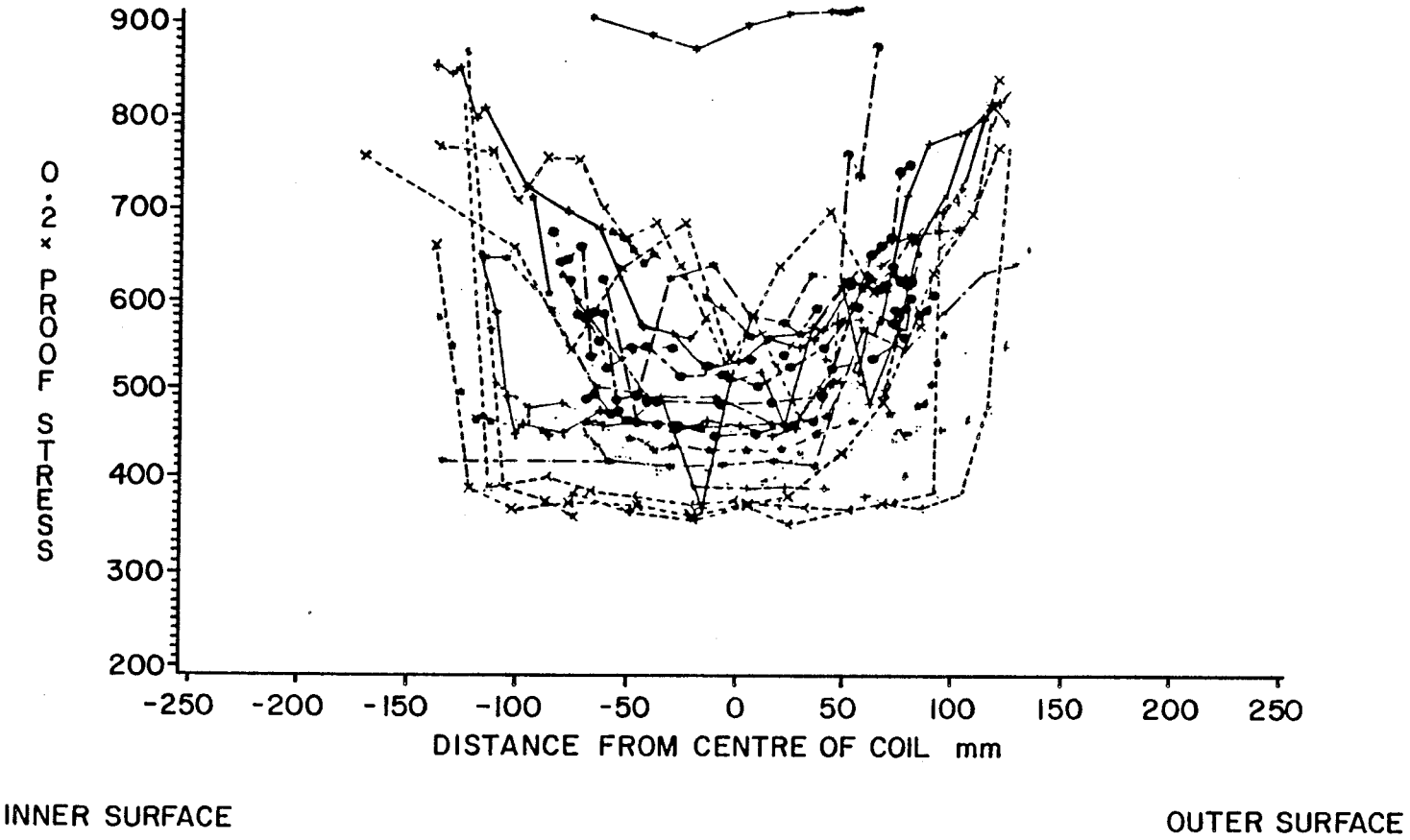
FIG. 1 illustrates the variation in properties relative to position in a coil, in as-rolled air cooled steel coils, subjected to mill watercooling and delays during rolling.
Figure 2:
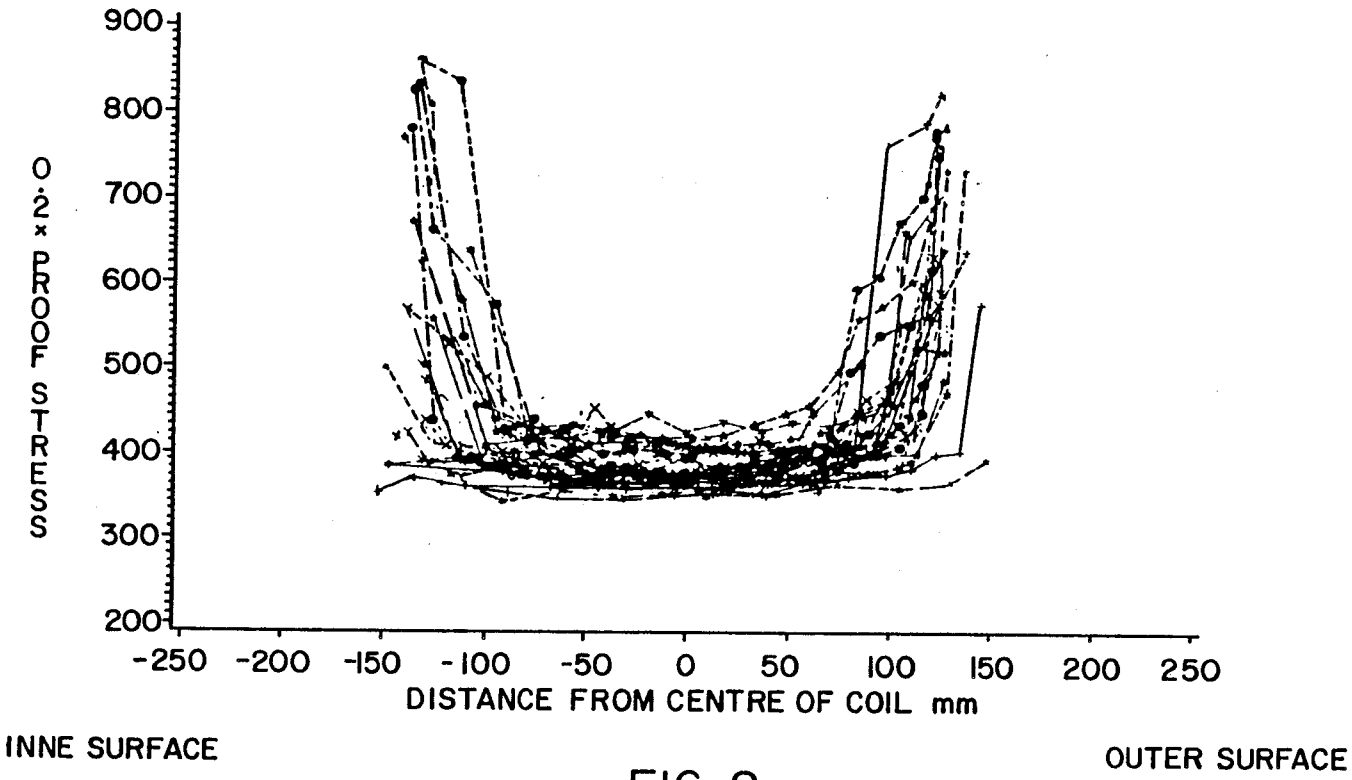
FIG. 2 illustrates the variation in properties shown in FIG. 1 but without delays or water cooling during rolling.
Figure 3:
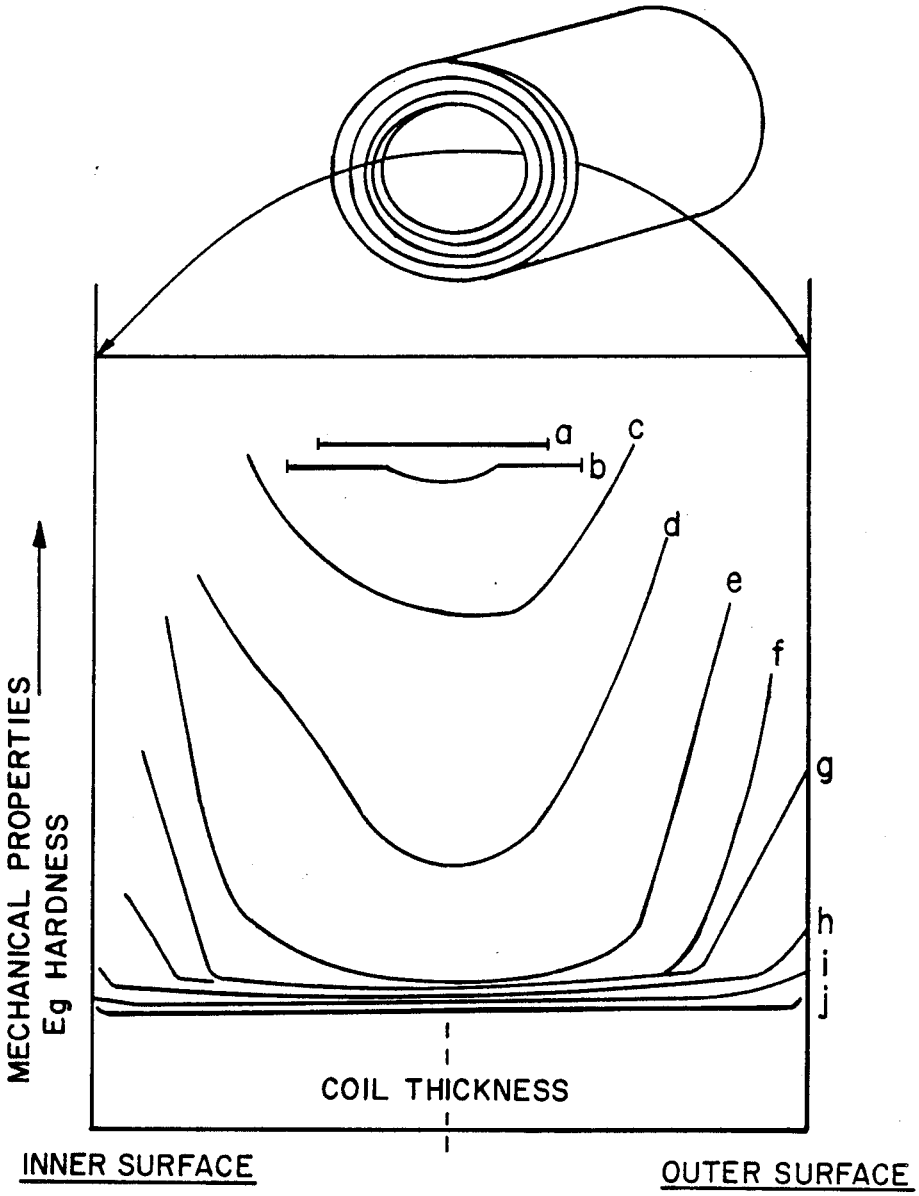
FIG. 3 illustrates the effect of coil mass on the variations shown in FIGS. 1 and 2.

Referring to FIGS. 1 to 3, the variation of properties in as-rolled air cooled steel coils of the type referred to is well known and, typically, have the patterns such as those illustrated in FIG. 1. It is generally known that the main causes for the wide degree of variation in the mechanical properties of these coils are :

i. water cooling on the mill, and/or ii. delays occurring during hot rolling caused by operational problems, and/or iii. deliberate stops to check the gauge of the steel.

These property variations make the annealing process necessary. When water cooling or operational delays are omitted and uninterrupted rolling effected, this results in the property variation pattern for the steel so produced as illustrated in FIG. 2, where the coils are essentially soft in the center but hard in the outer regions. Further, the effect of coil mass on these property variations for a given width of coil and a given steel composition, is schematically illustrated in FIG. 3. On FIG. 3, the distribution of the hardness across variously treated coils depending upon the degree of transformation is plotted. The plotted curves on the figure correspond as follows to the various degrees of transformation: (a) fully hard; (b) start of transformation in center; (d),(e),(f) increasing region fully transformed; and (i),(j) fully transformed product. The cause of these property behavior patterns can be shown to be related to the phase transformation behavior of the steel during continuous cooling, the so-called continuous cooling transformation diagram for the material (the CCT curves). The material at different positions in a hot coil will naturally cool at different rates. The outer edges and outer and inner laps (layers) of the coil will cool much faster than the material at the mid-center of the coil under ambient conditions. The time temperature path, and thus the microstructural transformations taking place, can vary from point to point within a coil.

In order to determine the Ferrite Factor which is useful in exercising this invention, the equations of the R. H. Kaltenhauser type are used. They have been modified to include the effect of Phosphorus which we have established as a further significant factor.

Thus Ferrite Factor $=\%Cr +6 \times \%Si +8 \times \%Ti +4 \times \%Nb +4 \times \%Mo +2 \times \%Al -2 \times \%Mn -4 \times \%Ni -40 \times (\%C +\%N) -20 \times \%P -5 \times \%Cu$ (% = mass per cent).

(The above formula for the Ferrite Factor is given by R. H. Kaltenhauser in "Improving the Engineering Properties of Ferritic Stainless Steels". Metals Engineering Quarterly, May 1971, page 41.) The Cu and P factors have been provisionally assigned at −5 and −20 respectively.

Figure 4:
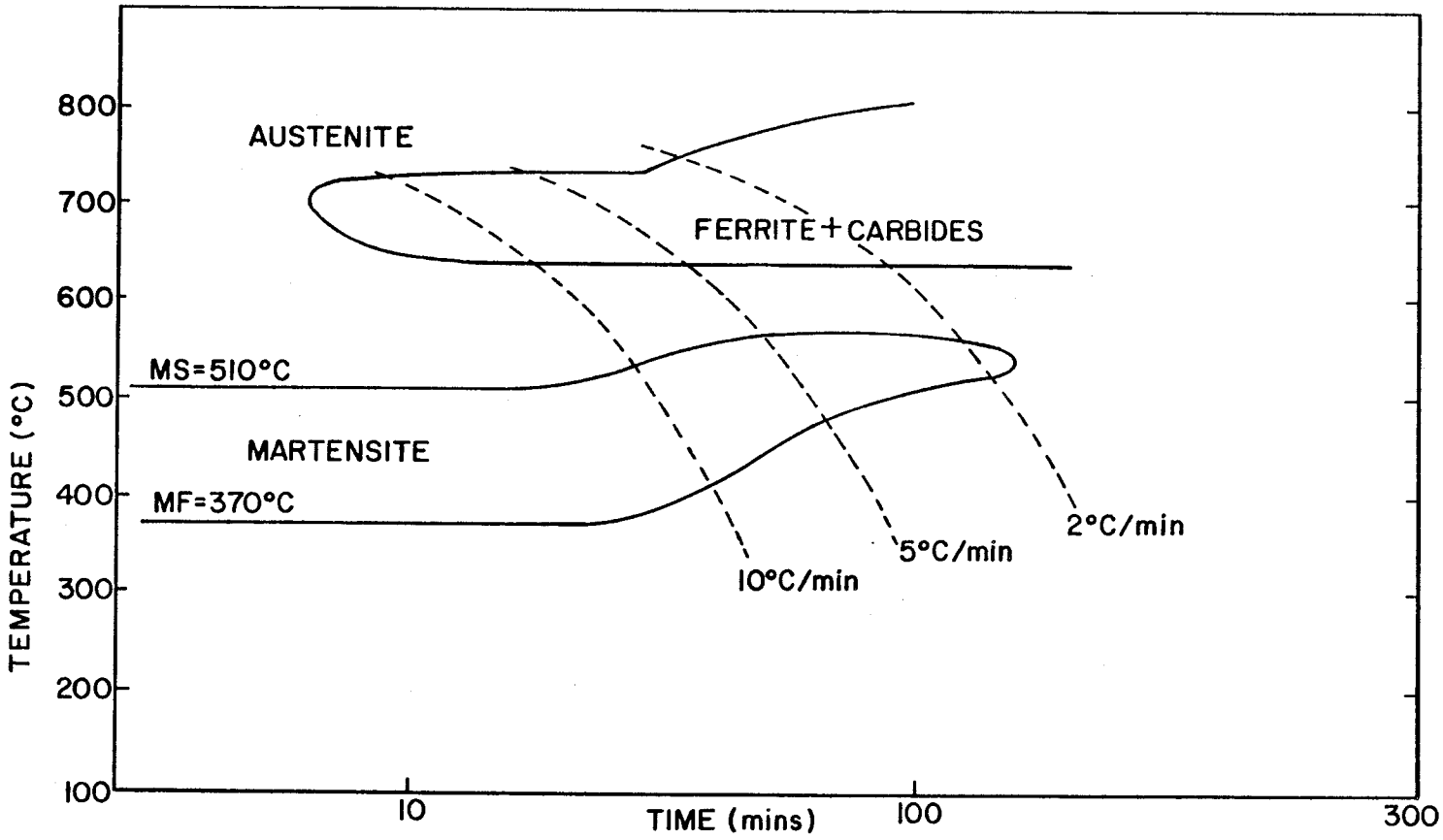
FIG. 4 shows a typical example of a CCT diagram.

FIG. 4 shows the CCT curves for different rates of cooling of steel compositions with a Ferrite Factor of 10,44.

Figure 5:
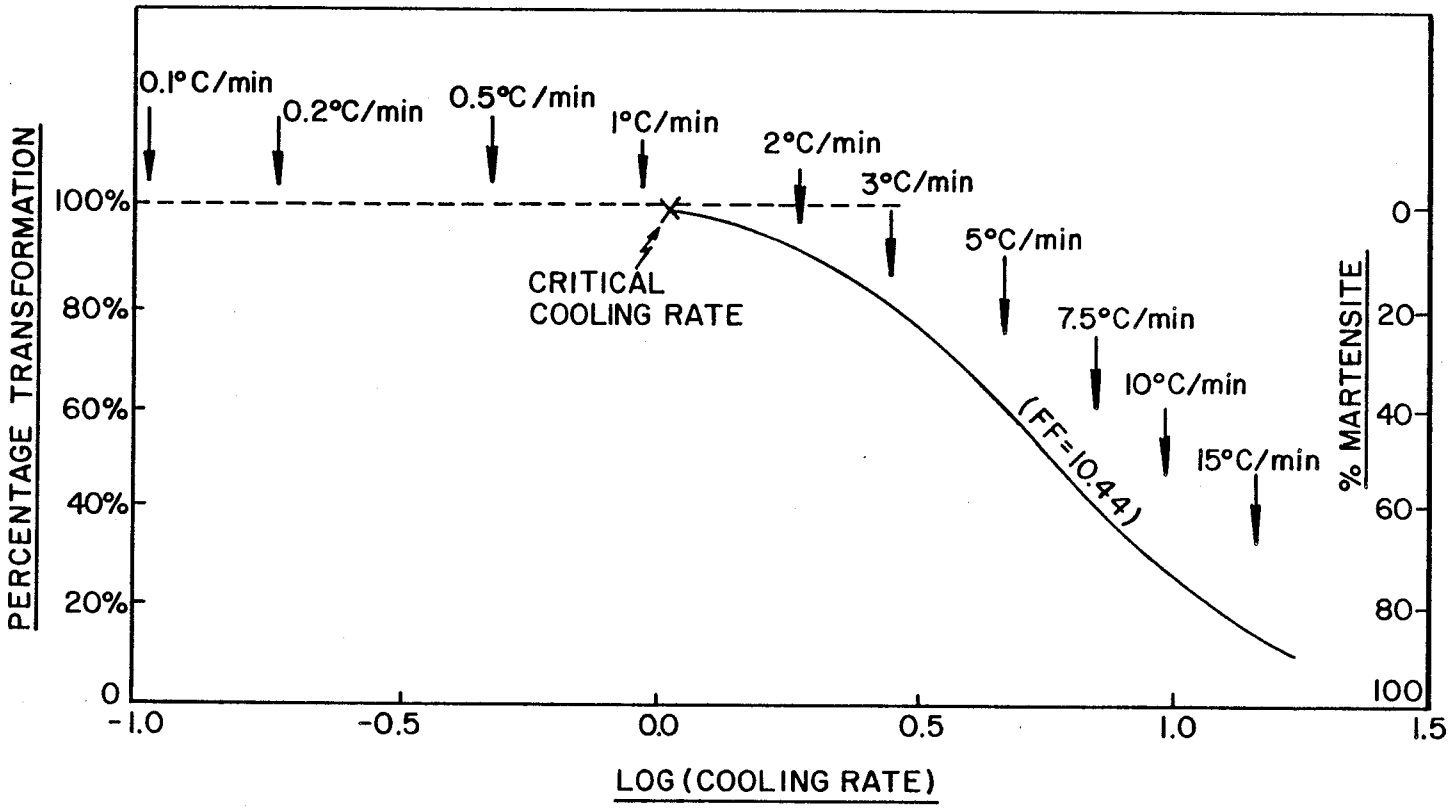
FIG. 5 shows an alternative representation of the same CCT diagram.

The alternative CCT representation in FIG. 5 shows the percentage transformation to predetermined phases at a series of cooling rates and for the same steel.

Clearly illustrated is the fact that there exists a critical cooling rate that gives a fully transformed product for a particular composition. Cooling rates slower than this critical rate do not significantly affect the properties of the product.

Figure 6:
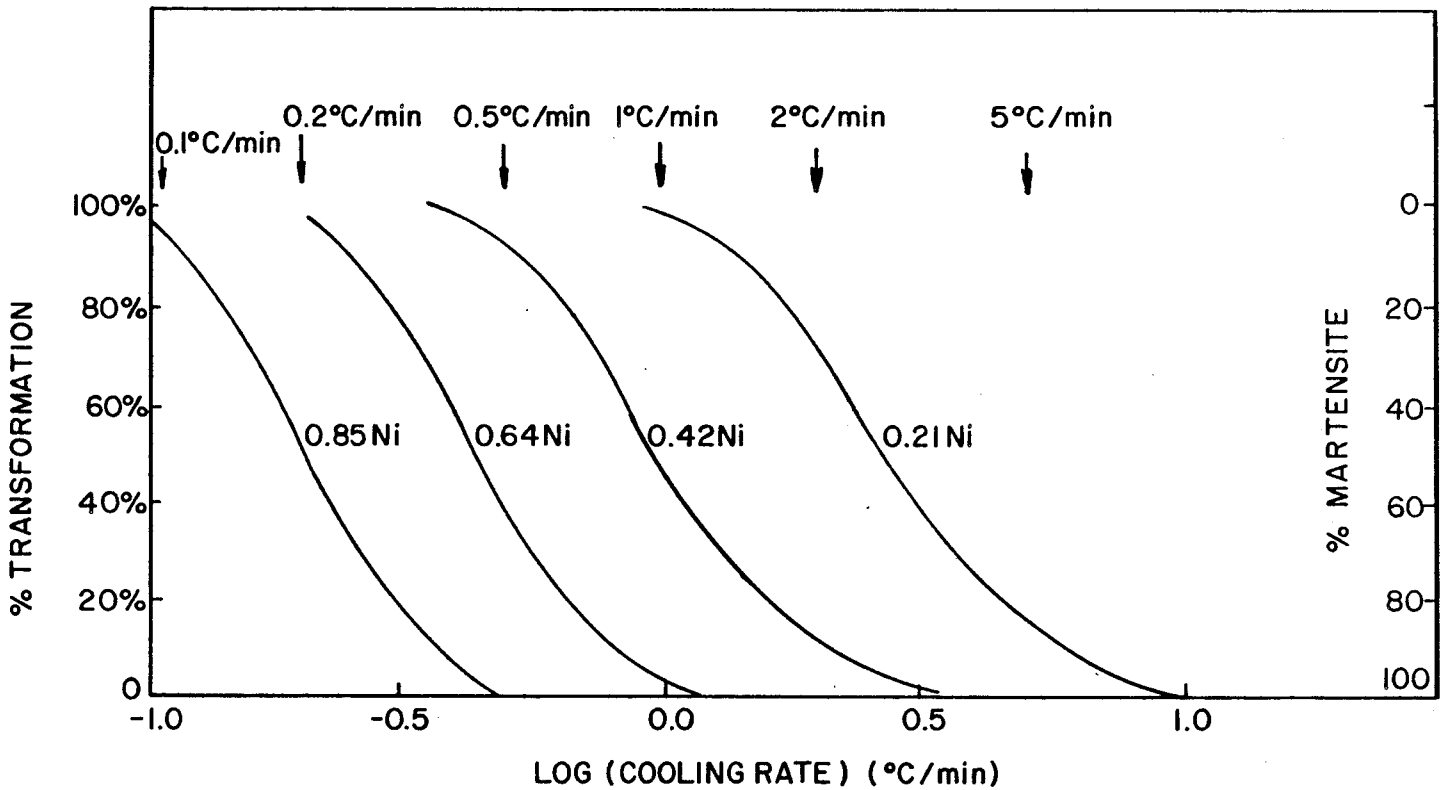
FIGS. 6 and 7 illustrate the variations of the phase transformation produced by changes in the nickel and phosphorus composition of an 11% Cr steel.
Figure 7:
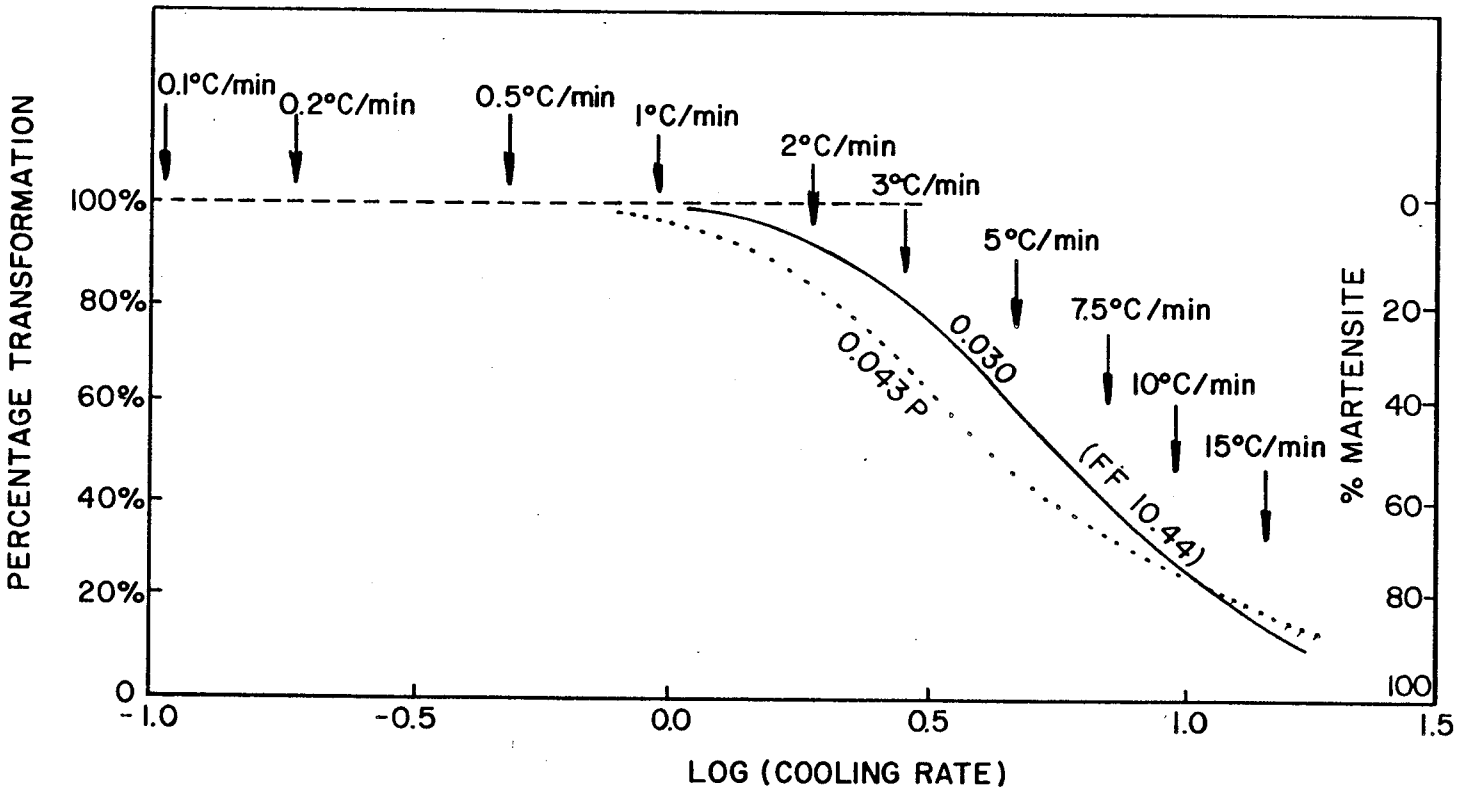

The positions of the phase boundaries on the CCT curves (FIGS. 4 and 5) are thus dependent on the composition of the steel. They can be moved by changes in composition, as illustrated in FIG. 6 for a change of Nickel content, and in FIG. 7 for a change in Phosphorus content for example. Other examples of how the positions of the phase boundaries may be changed by variations in composition are:

additions of Manganese, Cobalt, Aluminum and Niobium will generally move the upper transformation region to the right, whereas additions of Titanium, Vanadium and Molybdenum will generally move the upper transformation region to the left.

Further critical mass characteristics have been determined by practical production of steel with Ferrite Factors varying between 8 and 12.

To illustrate this principle, using an insulated box of outer dimensions 1900 mm cube, a 25 mm inner lining of Fibrefax and coils with an inner diameter of about 760 mm, the critical mass for different widths of coil cooled under insulated and ambient conditions have been found to be as follows:

| Width | 1000 ± 50 | 1250 ± 30 | 1550 ± 30 |
|---|---|---|---|
| With Hoods | 6 Tons | 8,5 Tons | 11,5 Tons |
| No Hoods | 10 Tons | 12,5 Tons | 15 Tons |

With masses greater than those shown for "No Hoods" the coils can be air cooled but, nevertheless, the transformation of the complete coil of steel to the predetermined phases will be obtained. Coils with a mass between the two values shown in the table are cooled under hoods using hoods in the form of an open bottomed metal box lined with suitable insulating material as referred to above. The lower limits for "With Hoods" treatment can be further reduced by thicker, or more efficient, insulation. Where the dimensions and composition of the coil indicate the need to use Hoods, it is important to note that these Hoods do not have to remain on the coil until the ambient temperature is reached. The hoods may be removed once the temperature has cooled to below the temperature of the upper phase region. For example, in FIG. 4 the Hoods could be removed when the temperature has cooled to 600° C.

The initial temperature of the coiled steel has clearly to be above the start of the transformation region. This is typically achieved by controlling the finishing temperature of the rolling process to above 850° C. This is normal hot rolling practice and does not present an additional requirement for the rolling operators.

Figure 8:
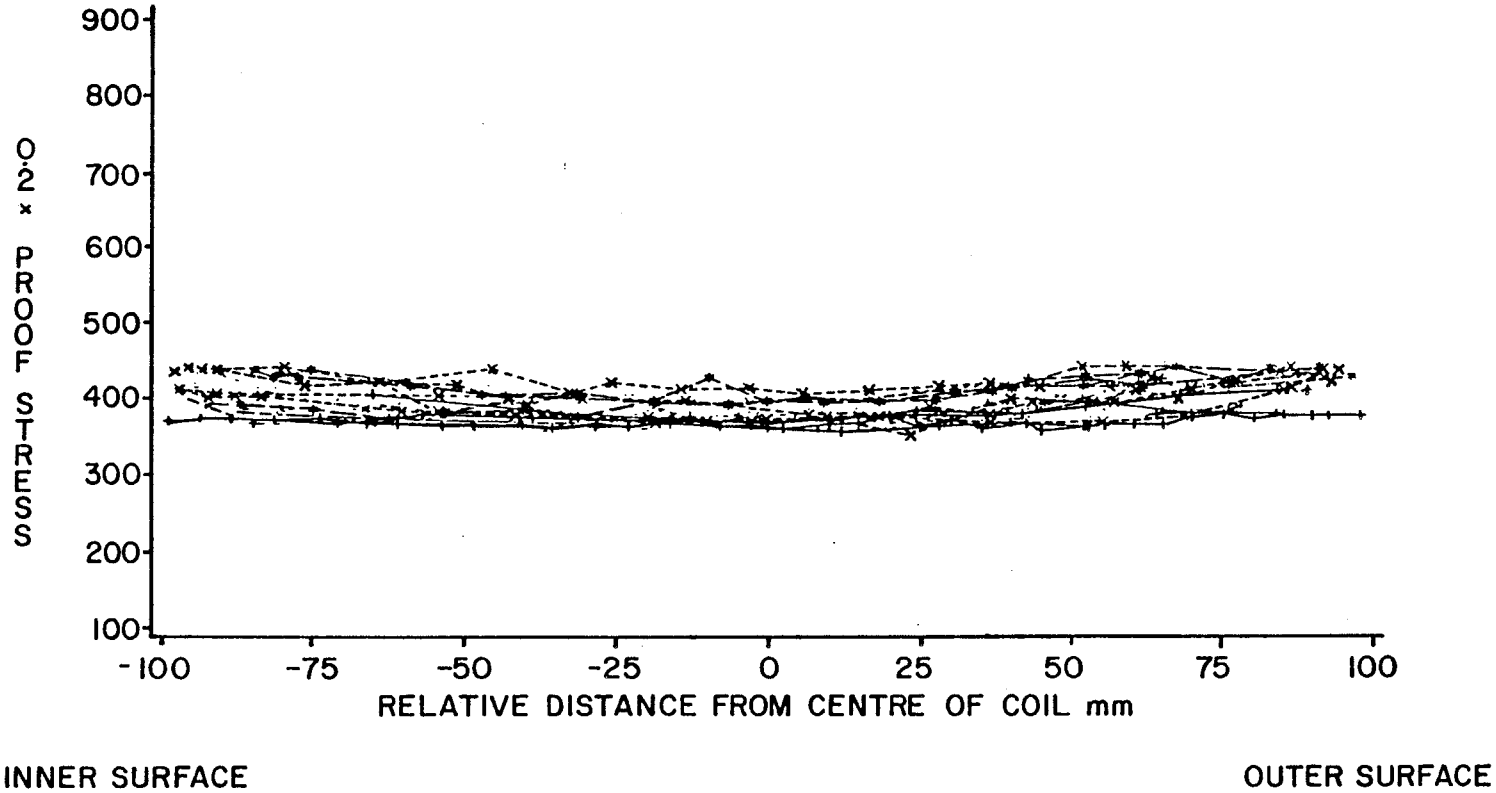
FIG. 8 illustrates the property variations after heat treatment according to the invention.

To further illustrate this point, the 68 steels shown in FIG. 8 were produced using Hoods. The Hoods were placed over the steel coils for two hours then removed and used for the next coil off the mill. In this way, over 1000 tons were successfully produced with 5 Hoods in under 20 hours. The annealing facilities, which would have had to be used for subsequent thermal treatment of this batch, were thus released for the processing of conventional Austenitic stainless steels.

The invention can be applied to steels with a minimum of alloying components such as those known commercially as AISI 409, 410, 420 as well as those with a more complex composition. Thus steel compositions with which this invention is particularly effective are those falling within the range of:

| | |
|---|---|
| Chromium | 10–18% |
| Manganese | 2,5% max |
| Silicon | 2,0% max |
| Nickel | 0,0–5% |
| Carbon | 0,25% max |
| Nitrogen | 0,1% max |
| Titanium | 0–1,0% |
| Molybdenum | 0–1,0% |
| Vanadium | 0–1,0% |
| Zirconium | 0–1,0% |
| Niobium | 0–1,0% |
| Copper | 0–2,0% |
| Aluminium | 0,5% max |
| Phosphorus | 0,1% max |

The balance being iron and unavoidable impurities.

The following are examples of suitable steel compositions :

| C | P | Mn | Si | Ti | Cr | Ni | $N_2$ | V |
|---|---|---|---|---|---|---|---|---|
| ,025 | ,025 | 1,2 | 0,4 | 0,35 | 11,25 | 0,6 | 0,015 | ,1 |
| ,015 | ,025 | 1,0 | 0,5 | — | 11,2 | 0,15 | 0,015 | ,1 |

Figures given are percentages by mass.

There are many steels falling into the above composition range which are not suitable for use with this invention owing to their having CCT curves requiring very slow cooling rates which are impractical for large production tonnages. It is, however, possible to correct this situation by, for example in one case, the additions of fractional percentages of Molybdenum or Titanium.

The impact of this invention will be clear to those skilled in the art. The capacity of mills with annealing plants and producing corrosion resistant plate can be increased simply by avoiding the inevitable bottleneck caused by an annealing process. Further, mills without annealing plant can be utilized to produce rolled plate by using the process of this invention.

Further, steel types which evidently require long batch-annealing cycles can now be produced utilizing large mass/insulation combinations which produce the required properties without the batch anneal process.

The corrosion resistant steels with which this invention is concerned are non-austenitic and particularly those the transformation phases of which are free from Martensite and Bainite. This results in steel which has all the workability properties usually only attainable after a controlled annealing process.

Further, it has been found that the alloying composition of these steels can, in many instances, avoid the necessity for the inclusion of stabilizing materials such as Titanium, Niobium, Zirconium or Vanadium provided the carbon level is suitably reduced. For example, these steels are suitable in applications for shipping containers, chutes and hoppers liners, ore wagons, coal and sugar washing plants and, generally, for wet sliding abrasive conditions.

The amount of energy saved by this process is significant. The theoretical amount of energy required to heat a ton of steel to, say 750° C., is dependent on the thermal properties of that steel. Typically, for a 13% Chromium steel, it is about 350MJ per ton. The thermal efficiency of continuous annealing, batch anneal or roller-hearth furnaces is dependent upon design and operating practices but 20% to 25% are reasonable values for illustration. The actual energy used is therefore about 1400MJ per ton.

As energy costs vary greatly with the source, i.e. gas, coal, oil or electricity, and from country to country, further comparisons are not easily made.

The major cost saving benefit from this invention is derived from the release of annealing or tempering capacity. Specific savings are dependent on the facilities available at each mill and the product mix, i.e. the ratio of Austenitic to non-austenitic stainless steels. In one particular situation, a capacity increase of about 12% was obtained as a result of this process. Additionally, the use of this process will allow production of steel grades, previously not possibly, with existing facilities.

As an example, AISI grades 410 and 420 are hardenable stainless steels for use in cutlery and cutting tool applications. They are supplied to the customer in the softened condition being subsequently hardened by the customer after forming into the required shape, for example, knife blades. Current practice involves a tempering, or annealing, process of the steel, usually in a batch annealing unit before delivery. The steels can now be produced using this invention and in a fully softened condition without having had any thermal process after hot rolling.

What I claim is new and desire to secure by Letters Patent is:

1. A method of producing a body in coil form of corrosion resistant steel comprising the steps of (a) selecting a corrosion resistant steel having (1) an austenite to ferrite and carbide transformation temperature (A3) between 650° C. and 850° C. and (2) a composition resulting in a steel having the substantial absence of martensite microstructure at cooling rates lower than 5 degrees C. per minute;

(b) hot working the steel body at above the A3 transformation temperature; and, (c) without cooling and reheating in an annealing furnace, cooling the hot worked steel body to below the transformation temperature at a cooling rate of between 10 degrees C. per minute and 1 degree C. per minute determined to ensure substantial absence of martensite microstructure throughout the body.

2. A method of producing a body in coil form of corrosion resistant steel comprising the steps of (a) selecting a corrosion resistant steel having (1) an austenite to ferrite and carbide transformation temperature ($A_3$) between 650° C. and 850° C. and (2) a composition resulting in a steel having the substantial absence of martensite microstructure at cooling rates lower than 5 degrees C. per minute;

(3) a composition having the following components, by weight percent:

| | |
|---|---|
| Chromium | 10–18 |
| Manganese | 2.5 maximum |
| Silicon | 2.0 maximum |
| Nickel | 0.0 to 5 |
| Carbon | 0.25 maximum |
| Nitrogen | 0.1 maximum |
| Titanium | 0 to 1 |
| Molybdenum | 0 to 1 |
| Vanadium | 0 to 1 |
| Zirconium | 0 to 1 |
| Niobium | 0 to 1 |
| Copper | 0 to 2 |
| Aluminum | 0.5 maximum |
| Phosphorous | 0.1 maximum; and, |

(b) hot working the steel body at above the A3 transformation temperature; and, (c) without cooling and reheating in an annealing furnace, cooling the hot worked steel body to below the transformation temperature at a cooling rate of between 10 degrees C. per minute and 1 degree C. per minute determined to ensure substantial absence of martensite microstructure throughout the body.

3. The method of claim 1 which includes insulating the body against excessive heat loss whilst the body is undergoing cooling.

4. The method of claim 2 which includes insulating the body against excessive heat loss whilst the body is undergoing cooling.

5. The method of claim 3 in which the body is at least partly enclosed in a thermally insulating housing whilst the body is undergoing cooling.

6. The method of claim 4 in which the body is at least partly enclosed in a thermally insulating housing whilst the body is undergoing cooling.

7. The method of claim 1 wherein the steel body is of material composition designed for production of corrosion resistant steel having a non austenitic microstructure.

8. The method of claim 2 wherein the steel body is of material composition designed for production of corrosion resistant steel having a non austenitic microstructure.

9. The method of claim 1 wherein Ferrite factor of the material composition of the steel body is determined by use of the following formula -Ferrite Factor=%CR+6 ×%Si+8 ×%Ti+4 ×%Nb +4 ×%Mo +2 ×%Al −2 ×%Mn−4 ×%Ni −40 ×(%C +%N) −20 ×%P−5 ×%Cu (%=weight per cent).

10. The method of claim 2 wherein Ferrite Factor of the material composition of the steel body is determined by use of the following formula -Ferrite Factor=%Cr+6 ×%Si +8 ×%Ti +4 ×%Nb +4 ×%Mo +2 ×%AI31 2 ×%Mn −4 ×%Ni −40 ×(%C +%N) −20 ×%P −5 ×%Cu (%=weight per cent).

11. The method of claim 9 wherein the determined Ferrite Factor of the steel body is used to construct a continuous cooling Transformation diagram which is used to determine the cooling rate of the steel body required to minimize formation of Martensite microstructures.

12. The method of claim 10 wherein the determined Ferrite Factor of the steel body is used to construct a continuous cooling Transformation diagram which is used to determine the cooling rate of the steel body required to minimize formation of Martensite microstructures.

13. The method of claim 11 wherein the Ferrite Factor lies between 8 and 12.

14. The method of claim 12 wherein the Ferrite Factor lies between 8 and 12.

15. The method of claim 5 which includes controlling the rate of cooing of the body by heat reflection from the interior surfaces of the thermally insulating housing.

16. The method of claim 6 which includes controlling the rate of cooing of the body by heat reflection from the interior surfaces of the thermally insulating housing.

17. The method of claim 5 which includes controlling the rate of cooling of the body by a lining of non-conductive insulation on the interior surfaces of the thermally insulating housing.

18. The method of claim 6 which includes controlling the rate of cooling of the body by a lining of non-conductive insulation on the interior surfaces of the thermally insulating housing.

19. The method of claim 15 wherein the thermally insulating housing is open bottomed and adapted to be lowered over the body.

20. The method of claim 16 wherein the thermally insulating housing is open bottomed and adapted to be lowered over the body.

21. The method of claim 17 wherein the thermally insulating housing is open bottomed and adapted to be lowered over the body.

22. The method of claim 18 wherein the thermally insulating housing is open bottomed and adapted to be lowered over the body.

23. A method of producing a coil of corrosion resistant steel having the substantial absence of martensite in the microstructure thereof comprising the steps of (a) selecting a corrosion resistant steel having (1) an austenite to ferrite and carbide transformation temperature ($A_3$) between 650° C. and 850° C. and (2) a ferrite factor between about 8 and 12;

(b) hot rolling and cooling the corrosion resistant steel above the transformation temperature; and (c) cooling the hot rolled coil without cooling and reheating in an annealing furnace to below the transformation temperature at a cooling rate of between 10 degrees C. per minute and 1 degree C. per minute determined to insure substantial absence of martensite microstructure throughout the coil.

24. A method of producing a coil of corrosion resistant steel having the substantial absence of martensite in the microstructure thereof comprising the steps of (a) selecting a corrosion resistant steel having (1) an austenite to ferrite and carbide transformation temperature ($A_3$) between 650° C. and 850° C., (2) a ferrite factor between about 8 and 12, and, (3) a composition having the following components, by weight percent:

| | |
|---|---|
| Chromium | 10–18 |
| Manganese | 2.5 maximum |
| Silicon | 2.0 maximum |
| Nickel | 0.0 to 5 |
| Carbon | 0.25 maximum |

-continued

| | |
|---|---|
| Nitrogen | 0.1 maximum |
| Titanium | 0 to 1 |
| Molybdenum | 0 to 1 |
| Vanadium | 0 to 1 |
| Zirconium | 0 to 1 |
| Niobium | 0 to 1 |
| Copper | 0 to 2 |
| Aluminum | 0.5 maximum |

-continued

| | |
|---|---|
| Phosphorous | 0.1 maximum; |

(b) hot rolling and cooling the corrosion resistant steel above the transformation temperature; and (c) cooling the hot rolled coil without cooling and reheating in an annealing furnace to below the transformation temperature at a cooling rate of between 10 degrees C. per minute and 1 degree C. per minute determined to insure substantial absence of martensite microstructure throughout the coil.

* * * * *

UNITED STATES PATENT AND TRADEMARK OFFICE

CERTIFICATE OF CORRECTION

PATENT NO. : 4,986,857

DATED : January 22, 1991

INVENTOR(S) : Jack Hewitt

It is certified that error appears in the above-identified patent and that said Letters Patent is hereby corrected as shown below:

On the title page item [56]:

Under References Cited FOREIGN PATENT DOCUMENTS insert
--0084902 3/1983 European Pat. Off. .
0201059 12/1986 European Pat. Off. .--.
and under OTHER PUBLICATIONS insert
--European Search Report, EP 89 30 5108 "Atlas of continuous cooling transformation diagrams for engineering steels". M. Atkins, B. Met, British Steel Corporation, ISBN 0 9500451 4 4. 1982, pgs. 129-133; "Continuous cooling transformation diagram 13Cr", pg. 132, upper diagram"--.

Column 1 Line 56 "use." should read --use,--.

Column 3 Line 1 "the' " should read --the--.

Column 3 Line 8 "watercooling" should read --water cooling--.

Column 3 Line 66 "%AI" should read --%Al--.

Claim 10 Line 60 Column 7 "%AI31 2" should read --%Al - 2--.

Claim 15 Line 12 Column 8 "cooing" should read --cooling--.

Claim 16 Line 15 Column 8 "cooing" should read --cooling--.

UNITED STATES PATENT AND TRADEMARK OFFICE

CERTIFICATE OF CORRECTION

PATENT NO. : 4,986,857

DATED : January 22, 1991

INVENTOR(S) : Jack Hewitt

It is certified that error appears in the above-identified patent and that said Letters Patent is hereby corrected as shown below:

Claim 16 Line 15 Column 8 "cooing" should read --cooling--.

Signed and Sealed this

Eleventh Day of August, 1992

*Attest:*

DOUGLAS B. COMER

*Attesting Officer*

*Acting Commissioner of Patents and Trademarks*